US009238954B2

(12) United States Patent
Acosta et al.

(10) Patent No.: US 9,238,954 B2
(45) Date of Patent: Jan. 19, 2016

(54) PRESSURE ACTIVATED DOWN HOLE SYSTEMS AND METHODS

(71) Applicant: Halliburton Energy Services, Inc., Houston, TX (US)

(72) Inventors: Frank Acosta, Duncan, OK (US); Nicholas Budler, Duncan, OK (US); David Szarka, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 263 days.

(21) Appl. No.: 13/734,035

(22) Filed: Jan. 4, 2013

(65) Prior Publication Data

US 2014/0048263 A1 Feb. 20, 2014

Related U.S. Application Data

(63) Continuation-in-part of application No. 13/585,954, filed on Aug. 15, 2012, now Pat. No. 9,033,056.

(51) Int. Cl.

| | |
|---|---|
| ***E21B 23/06*** | (2006.01) |
| ***E21B 34/14*** | (2006.01) |
| ***E21B 23/04*** | (2006.01) |

(52) U.S. Cl.

CPC ..... *E21B 34/14* (2013.01); *E21B 23/04* (2013.01); *E21B 23/06* (2013.01)

(58) Field of Classification Search

CPC ..... E21B 23/00; E21B 23/04; E21B 33/12; E21B 23/06; E21B 34/14

USPC ..... 166/373, 381, 383, 387

See application file for complete search history.

(56) References Cited

U.S. PATENT DOCUMENTS

| | | | | |
|---|---|---|---|---|
| 4,039,031 | A | 8/1977 | Crowe | |
| 4,660,637 | A | 4/1987 | McGill et al. | |
| 5,058,674 | A | 10/1991 | Schultz et al. | |
| 5,433,269 | A * | 7/1995 | Hendrickson | 166/134 |
| 9,033,056 | B2 | 5/2015 | Acosta et al. | |
| 2002/0121373 | A1 | 9/2002 | Patel | |

(Continued)

FOREIGN PATENT DOCUMENTS

WO 2014107395 A1 7/2014

OTHER PUBLICATIONS

International Search Report and Written Opinion for PCT/US2013/077821 dated Apr. 17, 2014.

(Continued)

*Primary Examiner* — Brad Harcourt

(74) *Attorney, Agent, or Firm* — McDermott Will & Emery LLP; John W. Wustenberg

(57) ABSTRACT

Systems and methods for activating a down hole tool in a wellbore. A piston is moveable from a first position to a second position for activating the down hole tool. The piston includes a first side exposed to an activation chamber, and a second side operatively coupled to the down hole tool. A rupture member has a first side exposed to the activation chamber and a second side exposed to the interior of a base pipe. The rupture member is configured to rupture when a pressure differential between the activation chamber and the interior reaches a predetermined threshold value, at which point the rupture member allows fluid communication between the interior and the activation chamber to pressurize the activation chamber and move the piston, thereby activating the down hole tool.

16 Claims, 4 Drawing Sheets

(56) References Cited

U.S. PATENT DOCUMENTS

| | | | | |
|---|---|---|---|---|
| 2004/0007366 | A1 | 1/2004 | McKee et al. | |
| 2004/0035591 | A1* | 2/2004 | Echols | 166/386 |
| 2008/0083541 | A1 | 4/2008 | Butterfield et al. | |
| 2008/0210429 | A1* | 9/2008 | McMillin et al. | 166/313 |
| 2009/0229832 | A1 | 9/2009 | King | |
| 2009/0272544 | A1 | 11/2009 | Giroux et al. | |
| 2009/0321081 | A1 | 12/2009 | Schramm et al. | |
| 2010/0084130 | A1* | 4/2010 | Richards et al. | 166/250.08 |
| 2014/0048281 | A1 | 2/2014 | Acosta et al. | |

OTHER PUBLICATIONS

International Search Report and Written Opinion for PCT/US2013/053552 dated Oct. 14, 2014.

Official Action for Australian Patent Application No. 2013371398 dated Aug. 31, 2015.

* cited by examiner

PRESSURE ACTIVATED DOWN HOLE SYSTEMS AND METHODS

CROSS-REFERENCE TO RELATED APPLICATION

This application claims the benefit of and is a continuation-in-part of U.S. patent application Ser. No. 13/585,954, filed Aug. 15, 2012, the contents of which are hereby incorporated by reference in their entirety.

BACKGROUND

The present invention relates to systems and methods used in down hole applications. More particularly, the present invention relates to the setting of a down hole tool in various down hole applications using pressure differentials between various fluid chambers surrounding or in the vicinity of the down hole tool.

In the course of treating and preparing a subterranean well for production, down hole tools, such as well packers, are commonly run into the well on a tubular conveyance such as a work string, casing string, or production tubing. The purpose of the well packer is not only to support the production tubing and other completion equipment, such as sand control assemblies adjacent to a producing formation, but also to seal the annulus between the outside of the tubular conveyance and the inside of the well casing or the wellbore itself. As a result, the movement of fluids through the annulus and past the deployed location of the packer is substantially prevented.

Some well packers are designed to be set using complex electronics that often fail or may otherwise malfunction in the presence of corrosive and/or severe down hole environments. Other well packers require that a specialized plug or other wellbore device be sent down the well to set the packer. While reliable in some applications, these and other methods of setting well packers add additional and unnecessary complexity and cost to the pack off process.

SUMMARY

The present invention relates to systems and methods used in down hole applications. More particularly, the present invention relates to the setting of a down hole tool in various down hole applications using pressure differentials between various fluid chambers surrounding or in the vicinity of the down hole tool.

In some embodiments, a system for activating a down hole tool in a wellbore includes a piston moveable from a first position to a second position for activating the down hole tool. The piston includes a first piston side exposed to a first chamber, and a second piston side exposed to a second chamber. A rupture member is provided and has a first member side exposed to the first chamber and a second member side exposed to a third chamber. The rupture member is configured to prevent fluid communication between the first chamber and the third chamber only until a pressure differential between the first chamber and the third chamber reaches a predetermined threshold value, at which point the rupture member ruptures and allows fluid communication between the first chamber and the third chamber. When the pressure differential is below the threshold value and the rupture member is intact, the piston is in the first position, and when the pressure differential reaches the threshold value and the rupture member ruptures, the piston moves to the second position and activates the down hole tool.

In other embodiments, a method is provided for activating a down hole tool in a wellbore. The down hole tool is coupled to a base pipe positioned within the wellbore and the base pipe cooperates with an inner surface of the wellbore to define an annulus. The method includes advancing the tool into the wellbore to a location in the annulus, and increasing pressure in the annulus to a pressure above a threshold value, which ruptures a rupture member and creates a pressure differential between a first chamber on a first side of a movable piston and a second chamber on a second side of the movable piston. The piston moves in response to the pressure differential to activate the down hole tool.

In yet other embodiments, a wellbore system includes a base pipe moveable along the wellbore. The base pipe includes a sleeve assembly defining a first chamber, a second chamber, and a third chamber. A moveable piston fluidly separates the first chamber and the second chamber. A down hole tool is disposed about the base pipe. The down hole tool is operatively coupled to the piston and is operable in response to movement of the piston. A rupture member fluidly separates the first chamber from the third chamber only until a pressure differential between the first chamber and the third chamber reaches a predetermined threshold value, at which point the rupture member ruptures and allows fluid communication between the first chamber and the third chamber, thereby reducing pressure in the first chamber and causing the piston to move toward the first chamber to operate the down hole tool.

In still other embodiments, a system for activating a down hole tool in a wellbore includes a base pipe defining an interior and an exterior. A piston is located on the exterior of the base pipe and is moveable from a first position to a second position for activating the down hole tool. The piston includes a first piston side exposed to a first chamber, and a second piston side engaged with the down hole tool. A rupture member has a first member side exposed to the first chamber and a second member side exposed to the interior. The rupture member is configured to prevent fluid communication between the first chamber and the interior only until a pressure differential between the first chamber and the interior reaches a predetermined threshold value, at which point the rupture member ruptures and allows fluid communication between the first chamber and the interior. When the pressure differential is below the threshold value and the rupture member is intact, the piston is in the first position. When the pressure differential reaches the threshold value and the rupture member ruptures, the piston moves to the second position and activates the down hole tool.

In still other embodiments, a method for activating a down hole tool in a wellbore includes advancing the down hole tool into the wellbore. The down hole tool is coupled to a base pipe positioned within the wellbore, and the base pipe defines an interior and an exterior. The down hole tool is located on the exterior. Pressure in the interior is increased to a pressure above a threshold value. A rupture member positioned between the interior and a first chamber on a first side of a movable piston ruptures when the pressure in the interior exceeds the threshold value, thereby causing an increase of pressure in the first chamber. The piston moves to activate the down hole tool in response to the increase of pressure in the first chamber.

In still other embodiments, a wellbore system includes a base pipe moveable along the wellbore. The base pipe defines an interior and includes a sleeve assembly defining a first chamber. A moveable piston includes a first end exposed to the first chamber. A down hole tool is disposed about the base pipe. The down hole tool is operatively coupled to a second end of the piston and is operable in response to movement of the piston. A rupture member fluidly separates the first chamber from the interior only until a pressure differential between the first chamber and the interior reaches a predetermined threshold value, at which point the rupture member ruptures and allows fluid communication between the first chamber and the interior, thereby increasing pressure in the first chamber and moving the piston to operate the down hole tool.

Features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods used in down hole applications. More particularly, the present invention relates to the setting of a down hole tool in various down hole applications using pressure differentials between various fluid chambers surrounding or in the vicinity of the down hole tool.

Systems and methods disclosed herein can be configured to activate and set a down hole tool, such as a well packer, in order to isolate the annular space defined between a wellbore and a base pipe (e.g., production tubing), thereby helping to prevent the migration of fluids through a cement column and to the surface. Other applications will be readily apparent to those skilled in the art. Systems and methods are disclosed that permit the down hole tool to be hydraulically-set without the use of electronics, signaling, or mechanical means. The systems and methods take advantage of pressure differentials between, for example, the annular space between the wellbore and the base pipe and one or more chambers formed in or around the tool itself and/or the base pipe. Consequently, the disclosed systems and methods simplify the setting process and reduce potential problems that would otherwise prevent the packer or down hole tool from setting. To facilitate a better understanding of the present invention, the following examples are given. It should be noted that the examples provided are not to be read as limiting or defining the scope of the invention.

Figure 1:
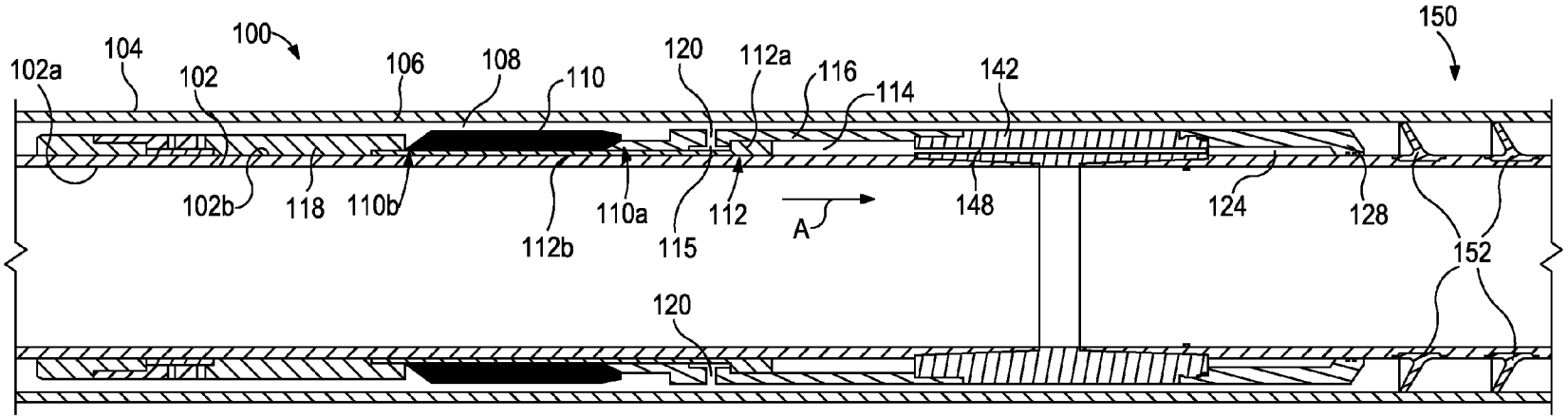
FIG. 1 illustrates a cross-sectional view of a portion of a base pipe and accompanying activation system, according to one or more embodiments disclosed.

Referring to FIG. 1, illustrated is a cross-sectional view of an exemplary activation system 100, according to one or more embodiments. The system 100 may include a base pipe 102 extending within a wellbore 104 that has been drilled into the Earth's surface to penetrate various earth strata containing, for example, hydrocarbon formations. It will be appreciated that the system 100 is not limited to any specific type of well, but may be used in all types, such as vertical wells, horizontal wells, multilateral (e.g., slanted) wells, combinations thereof, and the like. A casing 106 may be disposed within the wellbore 104 and thereby define an annulus 108 between the casing 106 and the base pipe 102. The casing 106 forms a protective lining within the wellbore 104 and may be made from materials such as metals, plastics, composites, or the like. In some embodiments, the casing 106 may be expanded or unexpanded as part of an installation procedure and/or may be segmented or continuous. In at least one embodiment, the casing 106 may be omitted and the annulus 108 may instead be defined between the inner wall of the wellbore 104 and the base pipe 102.

The base pipe 102 may include one or more tubular joints, having metal-to-metal threaded connections or otherwise threadedly joined to form a tubing string. In other embodiments, the base pipe 102 may form a portion of a coiled tubing. The base pipe 102 may have a generally tubular shape, with an inner radial surface 102*a* and an outer radial surface 102*b* having substantially concentric and circular cross-sections. However, other configurations may be suitable, depending on particular conditions and circumstances. For example, some configurations of the base pipe 102 may include offset bores, sidepockets, etc. The base pipe 102 may include portions formed of a non-uniform construction, for example, a joint of tubing having compartments, cavities or other components therein or thereon. Moreover, the base pipe 102 may be formed of various components, including, but not limited to, a joint casing, a coupling, a lower shoe, a crossover component, or any other component known to those skilled in the art. In some embodiments, various elements may be joined via metal-to-metal threaded connections, welded, or otherwise joined to form the base pipe 102. When formed from casing threads with metal-to-metal seals, the base pipe 102 may omit elastomeric or other materials subject to aging, and/or attack by environmental chemicals or conditions.

The system 100 may further include at least one down hole tool 110 coupled to or otherwise disposed about the base pipe 102. In some embodiments, the down hole tool 110 may be a well packer. In other embodiments, however, the down hole tool 110 may be a casing annulus isolation tool, a stage cementing tool, a multistage tool, formation packer shoes or collars, combinations thereof, or any other down hole tool. As the base pipe 102 is run into the well, the system 100 may be adapted to substantially isolate the down hole tool 110 from any fluid actions from within the casing 106, thereby effectively isolating the down hole tool 110 so that circulation within the annulus 108 is maintained until the down hole tool 110 is actuated.

In one or more embodiments, the down hole tool 110 may include a standard compression-set element that expands radially outward when subjected to compression. Alternatively, the down hole tool 110 may include a compressible slip on a swellable element, a compression-set element that partially collapses, a ramped element, a cup-type element, a chevron-type seal, one or more inflatable elements, an epoxy or gel introduced into the annulus 108, combinations thereof, or other sealing elements.

The down hole tool 110 may be disposed about the base pipe 102 in a number of ways. For example, in some embodiments the down hole tool 110 may directly or indirectly contact the outer radial surface 102*b* of the base pipe 102. In other embodiments, however, the down hole tool 110 may be arranged about or otherwise radially-offset from another component of the base pipe 102.

Figure 2:
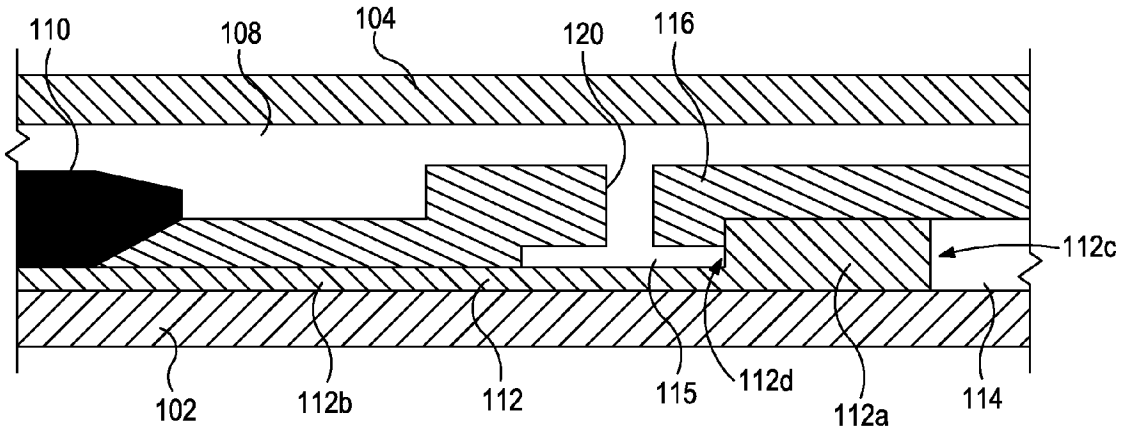
FIG. 2 illustrates an enlarged view of a portion of the activation system shown in FIG. 1.

Referring also to FIG. 2, the system 100 may include a piston 112 arranged external to the base pipe 102. As illustrated, the piston 112 may include an enlarged piston portion 112*a* and a stem portion 112*b* that extends axially from the piston portion 112*a* and interposes the down hole tool 110 and the base pipe 102. The piston portion 112*a* includes a first side 112*c* exposed to and delimiting a first chamber 114, and a second side 112*d* exposed to and delimiting a second chamber 115. Both the first chamber 114 and the second chamber 115 may be at least partially defined by a retainer element 116 arranged about the base pipe 102 adjacent a first axial end 110*a* (FIG. 1) of the down hole tool 110. In the illustrated embodiment, one or more inlet ports 120 may be defined in the retainer element 116 and provide fluid communication between the annulus 108 and the second chamber 115. In other embodiments, the second side 112*d* of the piston portion 112*a* may be exposed directly to the annulus 108. The stem portion 112*b* may be coupled to a compression sleeve 118 (FIG. 1) arranged adjacent to, and potentially in contact with, a second axial end 110*b* (FIG. 1) of the down hole tool 110.

As discussed below, the piston 112 is moveable in response to the creation of a pressure differential across the piston portion 112*a* in order to set the down hole tool 110. In one embodiment, a pressure differential experienced across the piston portion 112*a* forces the piston 112 to translate axially within the first chamber 114 in a direction A as it seeks pressure equilibrium. As the piston 112 translates in direction A, the compression sleeve 118 coupled to the stem portion 112*b* is forced up against the second axial end 110*b* of the down hole tool 110, thereby compressing and radially expanding the down hole tool 110. As the down hole tool 110 expands radially, it may engage the wall of the casing 106 and effectively isolate portions of the annulus 108 above and below the down hole tool 110.

As noted above, the second chamber 115 communicates with the annulus 108 via the ports 120 and therefore contains fluid substantially at the same hydrostatic pressure that is present in the annulus 108. Thus, as the system 100 is advanced into the wellbore 104 and moves downwardly into the Earth, hydrostatic pressure in the annulus 108 and the corresponding pressure in the second chamber 115 both increase. The first chamber 114 may also be filled with fluid, such as, for example, hydraulic fluid, water, oil, combinations thereof, or the like. As the system 100 is advanced into the wellbore 104, the piston portion 112*a* may be configured to transmit the pressure generated in the second chamber 115 to the fluid in the first chamber 114 such that the second chamber 115 and the first chamber 114 remain in substantial hydrostatic equilibrium, and the piston 112 thereby remains substantially stationary.

Figure 3:
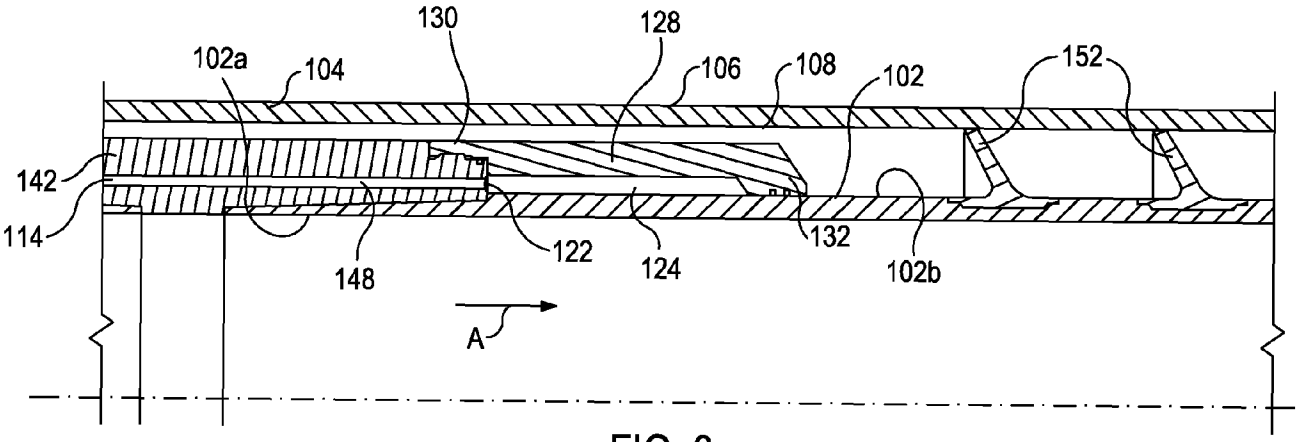
FIG. 3 illustrates an enlarged view of another portion of the activation system shown in FIG. 1.
Figure 4:
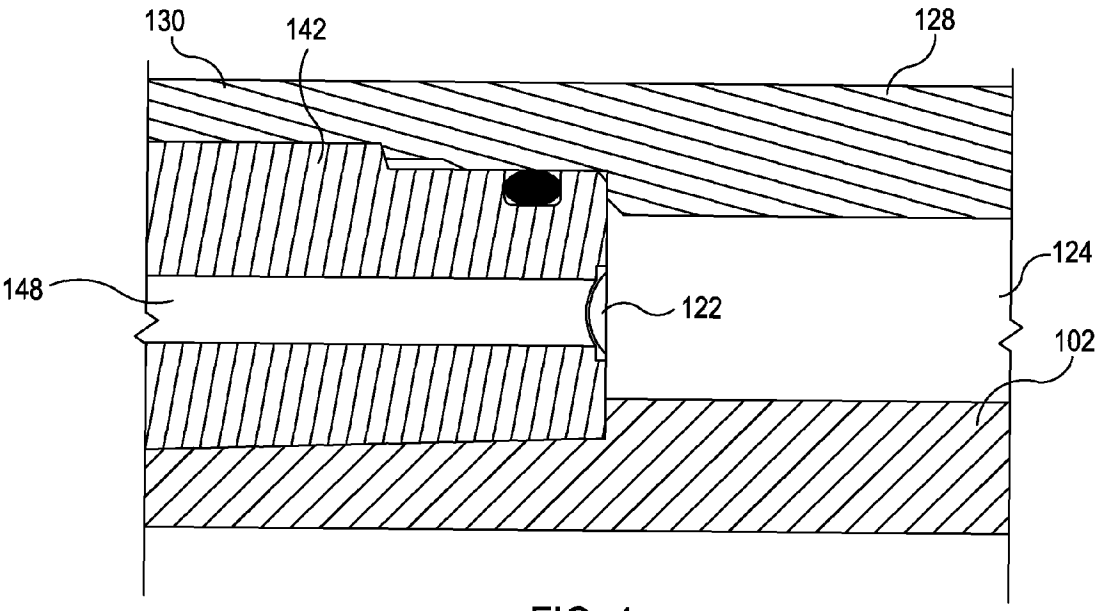
FIG. 4 illustrates a further enlarged view of the portion of the activation system shown in FIG. 3.

Referring also to FIGS. 3 and 4, the system 100 may further include a rupture member 122. In some embodiments, the rupture member 122 may be configured to rupture when subjected to a predetermined threshold pressure differential. Rupturing of the rupture member 122 may in turn establish a pressure differential across the piston portion 112*a* (FIGS. 1 and 2) sufficient to translate the piston 112 in the direction A, thereby causing the down hole tool 110 to set, as generally described above. The rupture member 122 may be or include, among other things, a burst disk, an elastomeric seal, a metal seal, a plate having an area of reduced cross section, a pivoting member held in a closed position by shear pins designed to fail in response to a predetermined shear load, an engineered component having built-in stress risers of a particular configuration, and/or substantially any other component that is specifically designed to rupture or fail in a controlled manner when subjected to a predetermined threshold pressure differential. The rupture member 122 may function substantially as a seal between isolated chambers only until a pressure differential between the isolated chambers reaches the predetermined threshold value, at which point the rupture member fails, bursts, or otherwise opens to allow fluid to flow from the chamber at higher pressure into the chamber at lower pressure. The specific size, type, and configuration of the rupture member 122 generally is chosen so that the rupture member 122 will rupture at a desired pressure differential. In some embodiments, the desired pressure differential may correspond to a desired depth within the wellbore 104 at which the down hole tool 110 is to be set.

In the embodiment of FIGS. 1 through 4, the rupture member 122 is exposed to and delimits the first chamber 114 from a third chamber 124. More specifically, a first side of the rupture member 122 is exposed to the first chamber 114, and a second side of the rupture member 122 is exposed to the third chamber 124. As shown in FIG. 3, the third chamber 124 is defined by a housing 128 having a first end 130 coupled to, for example, a hydraulic pressure transmission coupling 142, and a second end 132 in direct or indirect sealing engagement with the outer radial surface 102*b* of the base pipe 102. The hydraulic pressure transmission coupling 142 may define a conduit 148 that communicates with or is otherwise forms an integral part of the first chamber 114. Examples of other components that may define the conduit 148 include a lower shoe, a crossover component, and the like. The rupture member 122 is located in an end of the conduit 148 and acts as a seal between the first chamber 114 and the third chamber 124 when the rupture member 122 is intact.

In the illustrated embodiment, the third chamber 124 is substantially sealed and is maintained at a reference pressure, such as atmospheric pressure. Those skilled in the art will recognize that the third chamber 124 can be pressurized to substantially any reference pressure calculated based upon the anticipated hydrostatic pressure at a desired depth for setting the tool 110, and the pressure differential threshold value associated with the specific rupture member 122 that is in use. In some embodiments, the third chamber 124 may contain a compressible fluid, such as air or another gas, but in other embodiments may contain other fluids such as, hydraulic fluid, water, oil, combinations thereof, or the like.

As shown in FIGS. 1 and 3, the system 100 may also include a cup assembly 150 having at least one, e.g. two as illustrated, cups 152 located below the ports 120. In exemplary operation, the cups 152 may function as one-way valves within the annulus 108 and permit flow in the up hole direction (i.e., to the left in the figures) but substantially prevent or restrict flow in the down hole direction (i.e., to the right in the figures). Components that can be used as cups 152 include, for example, a swab cup, a single wiper, a modified wiper plug, a modified wiper cup, and the like, each of which can be formed of rubber, foam, plastics, or other suitable or flexible materials. By restricting flow in the down hole direction, the cups 152 allow an operator to increase pressure in the annulus 108 while the system 100 remains at substantially the same location within the wellbore 104. The cup assembly 150 and/or the cups 152 can be an integral portion of the system 100 or can be a separate component sealably connected to or with the base pipe 102.

Referring now to FIGS. 2 through 4, as the system 100 is advanced in the wellbore 104, hydrostatic pressure in the annulus 108 generally increases. Pressure in the second chamber 115 also increases due to the fluid communication provided by the ports 120. As pressure in the second chamber 115 increases, hydrostatic equilibrium is maintained between the second chamber 115 and the first chamber 114 by the piston 112 and the seal provided by the intact rupture member 122. Thus, the pressure in the first chamber 114 also increases. On the other hand, pressure in the third chamber 124 may remain substantially the same or may change at a different rate than the pressure in the first chamber 114. As a result, a pressure differential may develop across the rupture member 122. In general, the pressure differential across the rupture member 122 increases as the system is advanced into the wellbore 104.

Depending on the specific application, the down hole tool 110 may be advanced in the wellbore 104 until the hydrostatic pressure in the annulus 108 increases sufficiently to cause the pressure differential to reach the threshold value associated with the rupture member 122, thereby rupturing the rupture member 122. In other applications, the down hole tool 110 can be positioned in the wellbore 104 at a desired location and an operator can operate equipment located above or up hole of the down hole tool 110 to increase the pressure in the annulus 108 until the pressure differential across the rupture member 122 reaches the threshold value.

Regardless of how the pressure differential reaches the threshold value, when the threshold value is reached and the rupture member 122 ruptures, fluid flows from the higher-pressure first chamber 114, through the conduit 148, and into the lower-pressure third chamber 124, thereby reducing the pressure in the first chamber 114. Thus, pressure on the first side 112*c* of the piston portion 112*a* is reduced. Because the second side 112*d* of the piston portion 112*a* is exposed to the hydrostatic pressure in the annulus 108 by way of the second chamber 115 and the ports 120, a pressure differential is created across the piston portion 112*a*. The piston 112 therefore moves axially in direction A as it seeks to regain hydrostatic equilibrium. As the piston 112 moves axially in direction A, the compression sleeve 118 is correspondingly forced up against the second axial end 110*a* of the down hole tool 110, thereby resulting in the compression and radial expansion of the down hole tool 110. As a result, the down hole tool 110 expands radially and engages the wall of the casing 106 to effectively isolate portions of the annulus 108 above and below the down hole tool 110.

Figure 5:
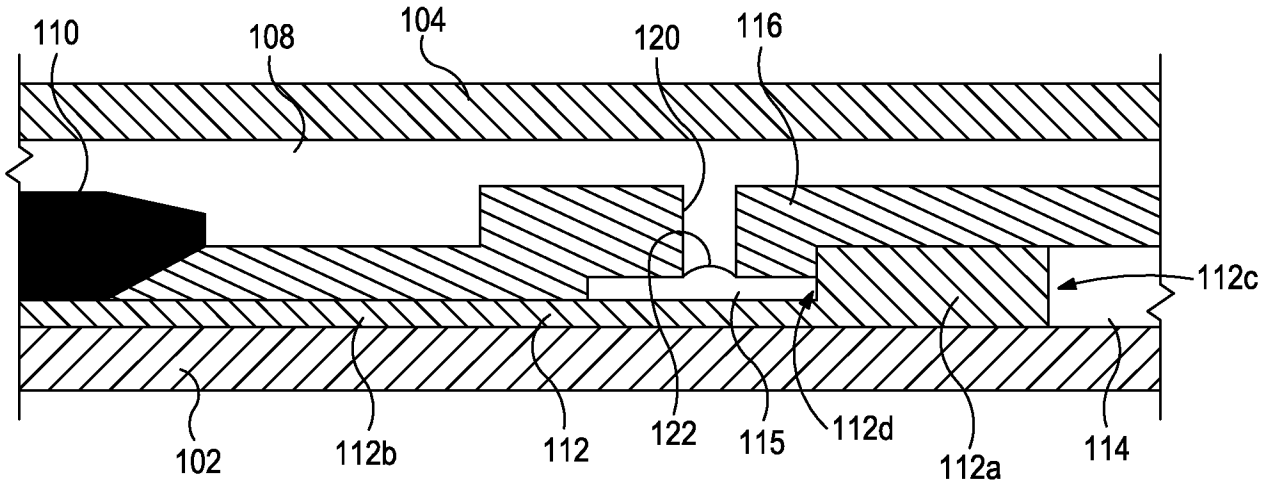
FIG. 5 illustrates an enlarged view of a portion of an alternative embodiment of an activation system, according to one or more embodiments disclosed.

Referring now to FIG. 5, in an alternative embodiment, the rupture member 122 may be located between the port 120 and the second chamber 115. In at least one embodiment, the rupture member 122 may be arranged or otherwise disposed within the port 122. In the embodiment of FIG. 5, for example, there is only one port 120 providing fluid communication between the annulus 108 and the second chamber 115, and that one port 120 has the rupture member 122 located therein. As the system 100 is advanced into the wellbore 104, the first chamber 114 and the second chamber 115 remain in substantial equilibrium while pressure in the port 120 increases as the hydrostatic pressure in the annulus 108 increases. In the embodiment of FIG. 5, the first and second chambers 114, 115 may contain a compressible fluid, such as air or another gas, that is maintained at a reference pressure, such as atmospheric pressure. As discussed previously, the reference pressure can be selected based upon, among other things, the anticipated hydrostatic pressure at a desired depth for setting the tool 110, and the pressure differential threshold value associated with the specific rupture member 122 that is in use. In other embodiments in which the rupture member is located between the port 120 and the second chamber 115, one or both of the first chamber 114 and the second chamber 115 may contain other fluids such as, hydraulic fluid, water, oil, combinations thereof, or the like.

Like the embodiments of FIGS. 1 through 4, the embodiment of FIG. 5 can be advanced into the wellbore 104 until the hydrostatic pressure in the annulus 108 increases such that the pressure differential between the annulus 108 and the second chamber 115 reaches the predetermined threshold value of the rupture member 122. Alternatively, the system 100 can be positioned in the wellbore 104 at a desired location and an operator can increase the pressure in the annulus 108 such that the pressure differential between the annulus 108 and the second chamber 115 reaches the predetermined threshold value of the rupture member 122. Either way, when the pressure differential reaches the predetermined threshold value of the rupture member 122, the rupture member 122 ruptures and the higher pressure fluid in the annulus 108 flows into the lower pressure second chamber 115. Pressure in the second chamber 115 increases, thereby creating a pressure differential across the piston portion 112*a* and causing the piston 112 to move axially in the direction A as it seeks a new fluid equilibrium. Movement of the piston 112 in the direction A sets the down hole tool 110 in the manner discussed above.

Figure 6:
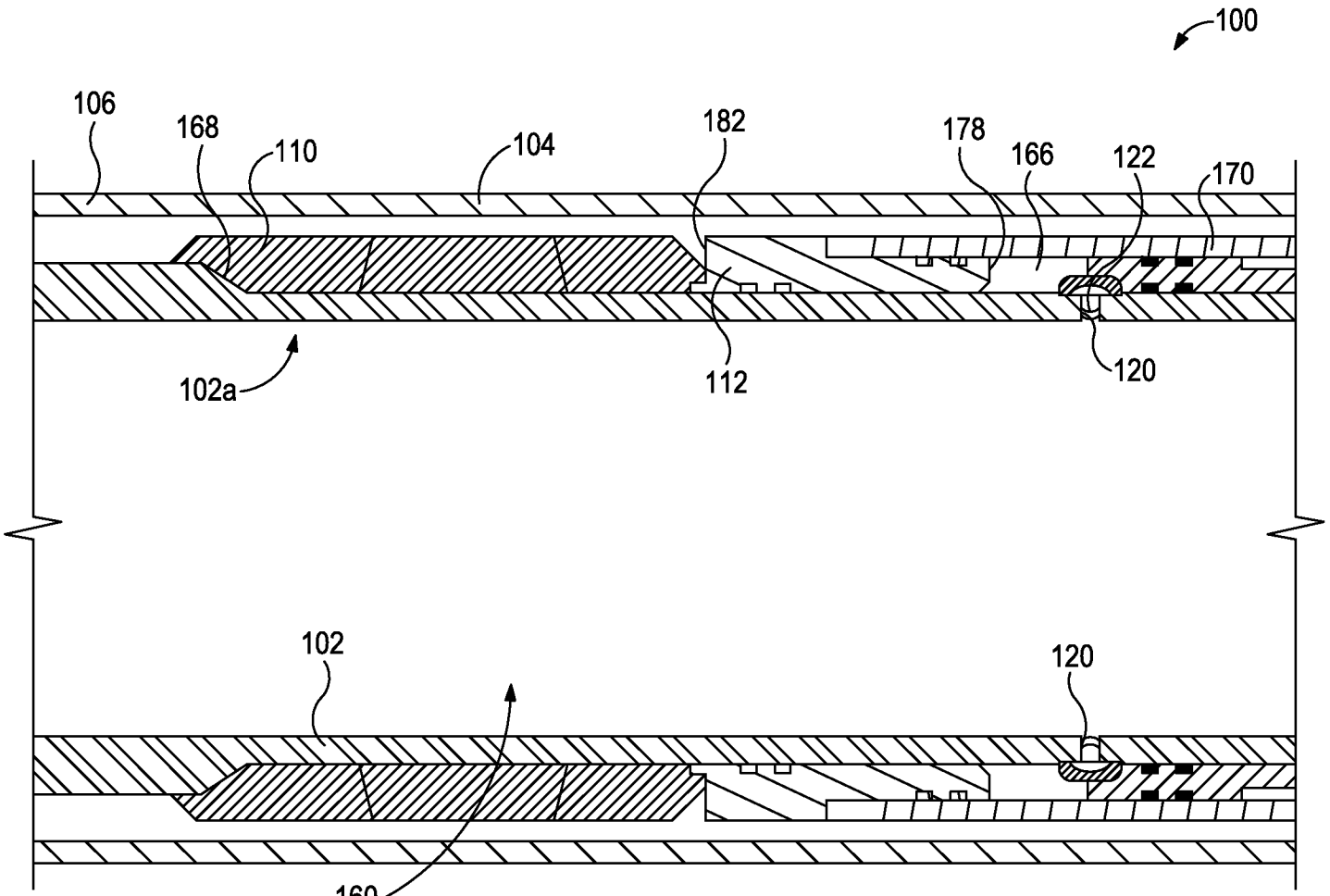
FIG. 6 illustrates a cross-sectional view of a portion of a base pipe and accompanying activation system, according to one or more alternative embodiments disclosed.

Referring also to FIG. 6, in another alternative embodiment, the system 100 may be configured for activation in response to increasing the pressure in an interior 160 of the base pipe 102. In this regard, the system 100 may include one or more ports 120 extending through or otherwise defined by or in the base pipe 102 and/or other system components for providing fluid communication between the interior 160 of the base pipe 102 and an activation chamber 166 defined about the exterior of the base pipe 102. In at least one embodiment, the rupture member 122 can be arranged or otherwise disposed within the port 120 defined by the base pipe 102 such that, as long as the rupture member 122 is intact, the rupture member 122 fluidly isolates the interior 160 from the activation chamber 166.

In the embodiment of FIG. 6, the activation chamber 166 is defined in part by one or more external sleeves 170 disposed about the base pipe 102. A movable element, such as piston 112, may have a first end 178 exposed to the activation chamber 166 and a second end 182 operatively coupled to or otherwise biasing the down hole tool 110 such that movement of the piston 112 causes the down hole tool 110 to activate and set. Although the illustrated system of FIG. 6 shows the piston 112 directly engaging the down hole tool 110, various sleeves, guides, and other intermediate structures can also be provided between the piston 112 and the down hole tool 110 depending on the configuration or needs of a particular application. In other embodiments, the piston 112 may be axially offset from the down hole tool 110 a short distance and only contacting the down hole tool 110 upon being activated, as described below. In the configuration of FIG. 6, the down hole tool 110 may include a resilient expansion element configured to expand radially outward when moved over a ramped cam surface 168, although any of the above-described alternative down-hole tool configurations could also be used.

In use, the base pipe 102 is advanced into the well bore 104 until the down hole tool 110 is at the desired location. A plug (not shown), which may be in the form of a ball, dart, or other flow-obstructing member, is landed down hole of the port 120 to prevent or restrict substantial fluid flow beyond the plug in the down hole direction. The plug allows an operator to increase pressure in the interior 160 of the base pipe 102 using equipment located above or up hole (for example, at the surface) of the down hole tool 110. As the pressure in the interior 160 increases, the pressure differential between the interior 160 and the activation chamber 166 also increases until the pressure differential reaches the threshold value of the rupture member 122 and causes the rupture member 122 to rupture. When the rupture member 122 ruptures, pressure from the interior 160 of the base pipe 102 is communicated through the port 120 and into the activation chamber 166. The increase in pressure in the activation chamber 166 causes the piston 112 to move, for example, to the left in FIG. 6. Movement of the piston pushes the resilient expansion element of the down hole tool 110 over the ramped cam surface 168, thereby expanding the expansion element and causing the down hole tool 110 to set.

Accordingly, the disclosed system 100 and related methods may be used to remotely set the down hole tool 110. The rupture member 122 activates the setting action of the down hole tool 110 without the need for electronic devices, magnets, or mechanical actuators, but instead relies on pressure differentials between the annulus 108, the interior 160, and various chambers provided in and/or around the tool 110 itself.

In the foregoing description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A system for activating a down hole tool in a wellbore, the system comprising:

a base pipe defining an interior, an exterior, and one or more ports;

an activation chamber defined by an external sleeve disposed about the base pipe, wherein the one or more ports facilitate fluid communication between the interior and the activation chamber;

a piston located on the exterior of the base pipe and including a first piston side exposed to the activation chamber and a second piston side biasing the down hole tool such that any movement of the piston causes the down hole tool to correspondingly move, wherein the piston is moveable within the activation chamber from a first position to a second position for activating the down hole tool; and a rupture member separating the activation chamber from the interior and preventing fluid communication therebetween until a pressure differential between the activation chamber and the interior reaches a predetermined threshold value, at which point the rupture member ruptures and allows fluid communication between the activation chamber and the interior, wherein when the rupture member is intact, the piston is in the first position, and when the rupture member ruptures, the piston moves to the second position and thereby activates the down hole tool.

2. The system of claim 1, wherein the rupture member is ruptured by increasing pressure in the interior to the predetermined threshold value.

3. The system of claim 1, wherein the rupture member is located in the one or more ports.

4. The system of claim 3, further comprising a plug located below the one or more ports, and wherein the plug enables increasing of the pressure differential between the activation chamber and the interior by increasing pressure in the interior.

5. The system of claim 1, wherein the piston is moveable in response to a pressure increase in the activation chamber that occurs in response to rupturing of the rupture member.

6. A method for activating a down hole tool in a wellbore, comprising:

advancing the down hole tool into the wellbore, the down hole tool being coupled to a base pipe defining an interior, an exterior, and one or more ports, wherein the down hole tool is located on the exterior, and wherein an activation chamber is defined by an external sleeve disposed about the base pipe and the one or more ports facilitate fluid communication between the interior and the activation chamber;

increasing pressure in the interior to a pressure above a threshold value;

rupturing a rupture member positioned between the interior and the activation chamber in fluid communication with a first side of a movable piston when the pressure in the interior exceeds the threshold value, thereby causing an increase of pressure in the activation chamber; and moving the piston within the activation chamber to activate the down hole tool in response to the increase of pressure in the activation chamber, wherein the piston includes a second piston side that biases the down hole tool such that any movement of the piston causes the down hole tool to correspondingly move.

7. The method of claim 6, wherein the rupture member is located in the one or more ports, and wherein increasing pressure in the interior further comprises:

landing a plug assembly in the interior below the one or more ports; and preventing fluid flow in the interior past the plug assembly.

8. The method of claim 6, wherein rupturing the rupture member further comprises opening a fluid communication path between the interior and the activation chamber.

9. The method of claim 6, wherein moving the piston further comprises moving the piston axially along the exterior of the base pipe.

10. The method of claim 6, wherein increasing pressure in the interior further comprises operating equipment located up hole of the down hole tool.

11. A wellbore system, comprising:

a base pipe moveable along the wellbore, the base pipe defining an interior and including a sleeve assembly defining an activation chamber;

a moveable piston having a first end exposed to the activation chamber;

a down hole tool disposed about the base pipe and biasing a second end of the piston such that any axial movement of the piston causes the down hole tool to correspondingly move; and a rupture member fluidly separating the activation chamber from the interior until a pressure differential between the activation chamber and the interior reaches a predetermined threshold value, at which point the rupture member ruptures and allows fluid communication between the activation chamber and the interior, thereby increasing pressure in the activation chamber and moving the piston within the activation chamber to operate the down hole tool.

12. The system of claim 11, further comprising a plug located in the interior below the down hole tool, wherein the plug restricts fluid flow past the plug in a down hole direction.

13. The system of claim 11, wherein the down hole tool is an annular packer, the system further comprising a cam surface disposed about the base pipe and an expansion sleeve engaging the second end of the piston, and wherein movement of the piston urges the annular packer over the cam surface to set the annular packer.

14. The system of claim 11, wherein the second end of the piston is exposed to an annulus of the wellbore.

15. The system of claim 11, wherein the rupture member is a burst disc.

16. The system of claim 11, wherein the base pipe defines a port extending between the interior and the activation chamber, and wherein the rupture member is located in the port.

* * * * *